US008708445B2

(12) United States Patent
Hatada et al.

(10) Patent No.: US 8,708,445 B2
(45) Date of Patent: Apr. 29, 2014

(54) PRINTING DEVICE, PRINTING METHOD, AND PROGRAM

(75) Inventors: Kenji Hatada, Shiojiri (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/207,744

(22) Filed: Aug. 11, 2011

(65) Prior Publication Data

US 2012/0038699 A1 Feb. 16, 2012

(30) Foreign Application Priority Data

Aug. 12, 2010 (JP) ..... 2010-180758

(51) Int. Cl.
*B41J 29/38* (2006.01)
*B41J 2/01* (2006.01)

(52) U.S. Cl.
USPC ..... 347/16; 347/101; 347/104

(58) Field of Classification Search
None
See application file for complete search history.

(56) References Cited

U.S. PATENT DOCUMENTS

| | | | | |
|---|---|---|---|---|
| 5,724,085 | A * | 3/1998 | Inui et al. | 347/175 |
| 2009/0245912 | A1 | 10/2009 | Igarashi et al. | |
| 2009/0269119 | A1 | 10/2009 | Hatada et al. | |
| 2010/0053251 | A1 | 3/2010 | Igarashi et al. | |

FOREIGN PATENT DOCUMENTS

| | | | | |
|---|---|---|---|---|
| JP | 59-064463 | A | 4/1984 | |
| JP | 61-027861 | A | 2/1986 | |
| JP | 63-202551 | * | 8/1988 | B65H 23/188 |
| JP | 2009-234177 | A | 10/2009 | |
| JP | 2009-242047 | A | 10/2009 | |
| JP | 2009-242048 | * | 10/2009 | B65H 23/185 |
| JP | 2009-242048 | A | 10/2009 | |
| JP | 2009-256095 | A | 11/2009 | |
| JP | 2009-263044 | A | 11/2009 | |
| JP | 2009-280398 | A | 12/2009 | |
| JP | 2010-052379 | A | 3/2010 | |
| JP | 2010-52931 | A | 3/2010 | |
| JP | 2010-111057 | A | 5/2010 | |

* cited by examiner

*Primary Examiner* — Geoffrey Mruk
(74) *Attorney, Agent, or Firm* — Nutter McClennen & Fish LLP; John J. Penny, Jr.; Christina M. Sperry

(57) ABSTRACT

A printing device includes:

a driving motor that applies a power rotating a roll body in which a medium is rolled;

a driving roller that transfers the power of the driving motor to the roll body; a transport motor that applies a power transporting the medium; a transport roller that is provided further to the downstream side than the roll body in the transport direction of the medium; and a looseness acquiring unit that acquires an looseness between the driving roller and the transport roller. When the looseness is equal to or more than a predetermined looseness, the driving motor is controlled on the basis of the looseness acquired by the looseness acquiring unit. When the looseness is less than the predetermined looseness, the driving motor is controlled on the basis of tension between the driving roller and the transport roller.

15 Claims, 8 Drawing Sheets

PRINTING DEVICE, PRINTING METHOD, AND PROGRAM

BACKGROUND

1. Technical Field

The present invention relates to a printing device, a printing method, and a program.

2. Related Art

There is an ink jet printer of a type using wide paper with a paper size of A2 or more. In such an ink jet printer using the wide paper, there are many cases of using so-called roll paper in addition to cut paper. The paper (a part coming from the roll body) may drawn out from the roll body (so-called roll paper in which paper is rolled) by rotating the roll body using a motor. JP-A-2009-256095, JP-A-2009-280398, JP-A-2010-111057, and JP-A-2010-52931 are examples of the related art.

However, in a case of the roll body having a great amount of rolled paper, an inertia moment of the roll body itself is large. Accordingly, it is difficult to brake the roll body due to the large inertia moment, and thus the amount of looseness of the medium between the roll body and a transport roller may be larger than necessary.

SUMMARY

An advantage of some aspects of the invention is to appropriately adjust the amount of looseness of the medium between the roll body and the transport roller.

According to an aspect of the invention, there is provided a printing device including: a driving motor that applies a driving power rotating a roll body in which a medium is rolled; a driving roller that transfers the driving power of the driving motor to the roll body; a transport motor that applies a driving power transporting the medium; a transport roller that is provided further to the downstream side than the roll body in the transport direction of the medium and transfers the driving power of the transport motor to the medium; and a looseness amount acquiring unit that acquires an amount of looseness between the driving roller and the transport roller, wherein when the amount of looseness is equal to or more than a predetermined amount of looseness, the driving motor is controlled on the basis of the amount of looseness acquired by the looseness amount acquiring unit, and when the amount of looseness is less than the predetermined amount of looseness, the driving motor is controlled on the basis of tension between the driving roller and the transport roller.

Other aspects of the invention will be made clear by the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
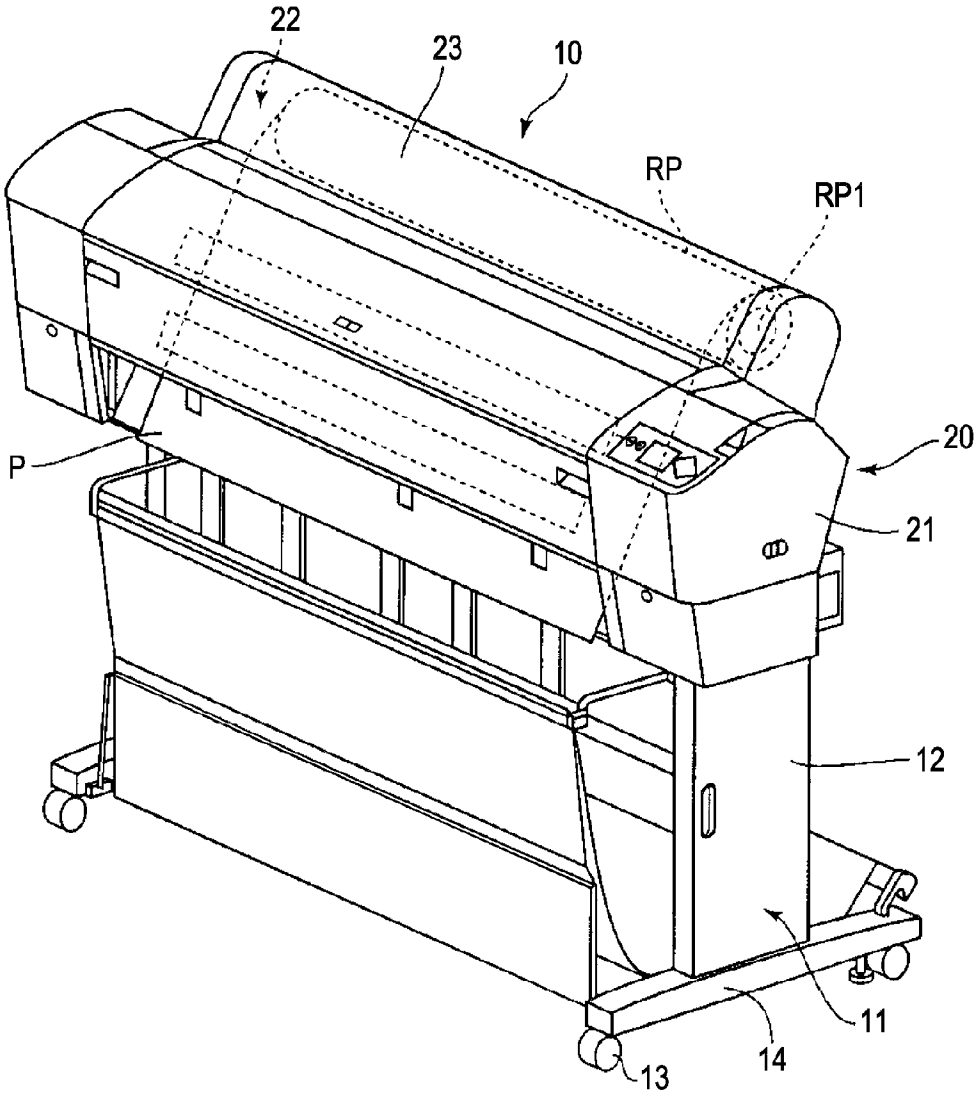
FIG. 1 is a perspective view illustrating an example of a configuration of an appearance of a printer according to an embodiment.

At least the following will be made clear by the description of the specification and the accompanying drawings.

There is provided a printing device including: a driving motor that applies a driving power rotating a roll body in which a medium is rolled; a driving roller that transfers the driving power of the driving motor to the roll body; a transport motor that applies a driving power transporting the medium; a transport roller that is provided further to the downstream side than the roll body in the transport direction of the medium and transfers the driving power of the transport motor to the medium; and a looseness amount acquiring unit that acquires an amount of looseness between the driving roller and the transport roller, wherein when the amount of looseness is equal to or more than a predetermined amount of looseness, the driving motor is controlled on the basis of the amount of looseness acquired by the looseness amount acquiring unit, and when the amount of looseness is less than the predetermined amount of looseness, the driving motor is controlled on the basis of tension between the driving roller and the transport roller.

With such a configuration, it is possible to appropriately adjust the amount of looseness of the medium between the roll body and the transport roller.

In the printing device, it is preferable that the looseness amount acquiring unit acquires the amount of looseness by measuring an amount of looseness of the medium. The looseness amount acquiring unit may acquire the amount of looseness on the basis of an amount of transport of the medium transported by the driving roller and an amount of transport of the medium transported by the transport roller.

With such a configuration, it is possible to appropriately adjust the amount of looseness of the medium between the roll body and the transport roller.

There is provided a printing method of a printing device including a driving motor that applies a driving power rotating a roll body in which a medium is rolled, a driving roller that transfers the driving power of the driving motor to the roll body, a transport motor that applies a driving power transporting the medium, a transport roller that is provided further to the downstream side than the roll body in the transport direction of the medium and transfers the driving power of the transport motor to the medium, and a looseness amount acquiring unit that acquires an amount of looseness between the driving roller and the transport roller, the method including: acquiring the amount of looseness between the driving roller and the transport roller; controlling the driving motor on the basis of the amount of looseness acquired by the looseness amount acquiring unit when the amount of looseness is equal to or more than a predetermined amount of looseness; and controlling the driving motor on the basis of tension between the driving roller and the transport roller when the amount of looseness is less than the predetermined amount of looseness.

With such a configuration, it is possible to appropriately adjust the amount of looseness of the medium between the roll body and the transport roller.

A program executed on a printing device including a driving motor that applies a driving power rotating a roll body in which a medium is rolled, a driving roller that transfers the driving power of the driving motor to the roll body, a transport motor that applies a driving power transporting the medium, a transport roller that is provided further to the downstream side than the roll body in the transport direction of the medium and transfers the driving power of the transport motor to the medium, and a looseness amount acquiring unit that acquires an amount of looseness between the driving roller and the transport roller, the program causing the printing device to execute: acquiring the amount of looseness between the driving roller and the transport roller; controlling the driving motor on the basis of the amount of looseness acquired by the looseness amount acquiring unit when the amount of looseness is equal to or more than a predetermined amount of looseness; and controlling the driving motor on the basis of tension between the driving roller and the transport roller when the amount of looseness is less than the predetermined amount of looseness.

With such a configuration, it is possible to appropriately adjust the amount of looseness of the medium between the roll body and the transport roller.

Embodiments

Configuration of Printer

Hereinafter, a printer 10 as a printing device according to an embodiment, and a control process thereof will be described. For example, the printer 10 of the embodiment is a printer for printing of wide paper equal to or more than the A4 size of the JIS standard. The printer of the embodiment is an ink jet printer. The ink jet printer may be a device employing any ejection method if it is a device ejecting ink to perform printing.

Figure 2:
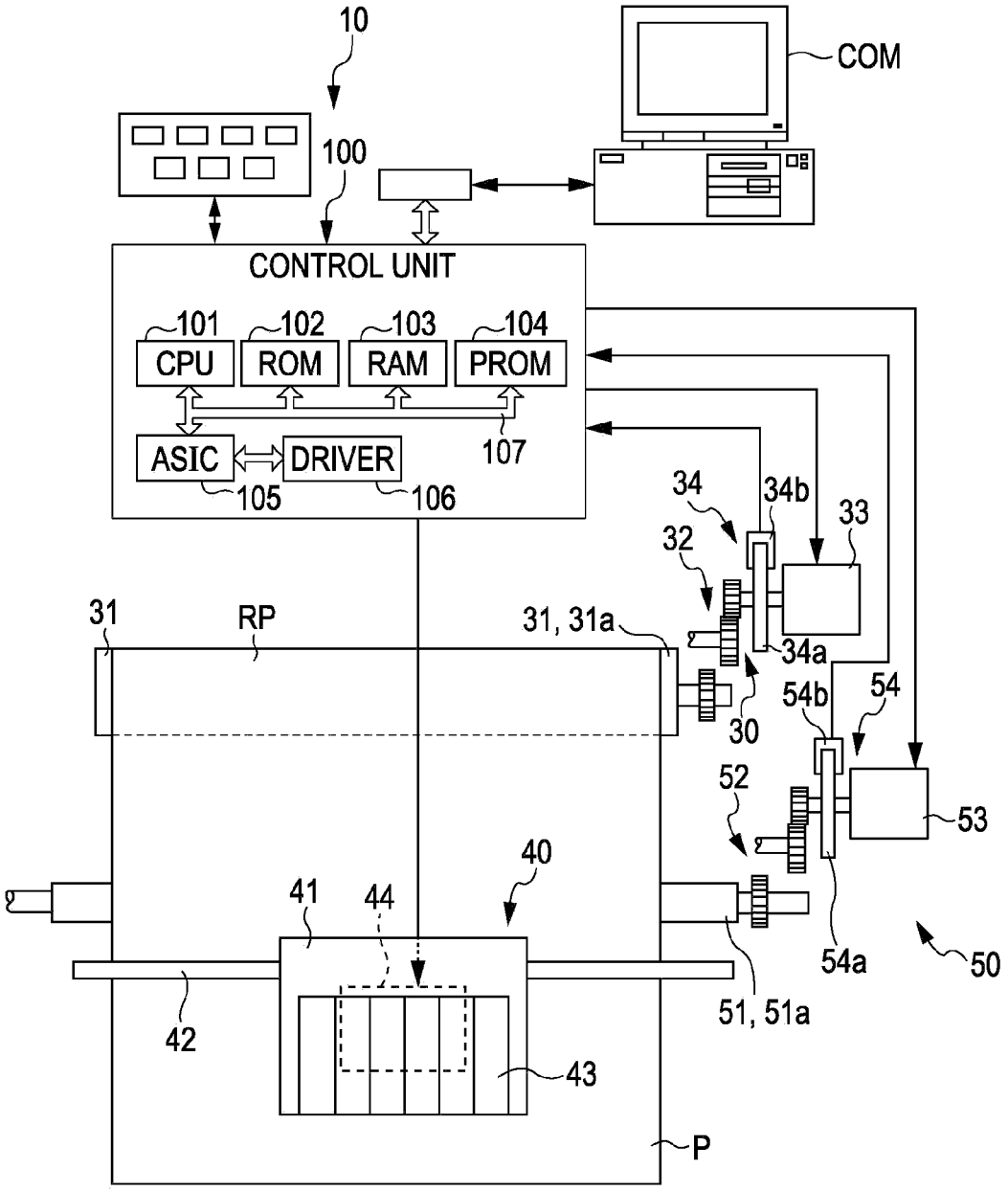
FIG. 2 is a diagram illustrating a relation between a control system and a driving system using a DC motor in the printer.
Figure 3:
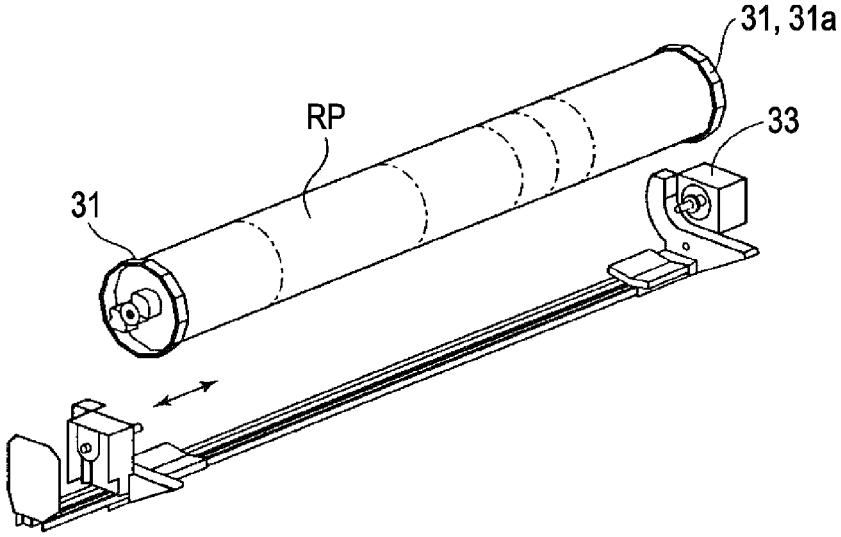
FIG. 3 is a perspective view illustrating a configuration of a rotation holder holding a roll body.

FIG. 1 is a perspective view illustrating an example of a configuration of an appearance of the printer 10 according to the embodiment. FIG. 2 is a diagram illustrating a relation between a control system and a driving system using a DC motor in the printer 10. FIG. 3 is a perspective view illustrating a configuration of a rotation holder holding a roll body. In this example, the printer 10 includes a pair of leg portions 11, a main body portion 20 supported by the leg portions 11. The leg portions 11 are provided with support pillars 12, and casters 13 which are rotatable members are attached to caster support portions 14. The main body portion 20 is provided therein with various devices in a state where the main body portion 20 is supported by a chassis (not shown), and they are covered with an external case 21. As shown in FIG. 2, the main body portion 20 is provided with a roll driving mechanism 30, a carriage driving mechanism 40, and a paper transport mechanism 50, as the driving system using the DC motor.

The roll driving mechanism 30 is provided in a roll mounting portion 22 of the main body portion 20. As shown in FIG. 1, the roll mounting portion 22 is provided on the back side and the upper side of the main body portion 20. An opening and closing cover 23 that is an element constituting the external case 21 described above is opened, then a roll body RP is mounted therein, and the roll body RP can be rotated by the roll driving mechanism 30. As shown in FIG. 2 and FIG. 3, the roll driving mechanism 30 for rotating the roll body RP includes a rotation holder 31, a gear 32, an RR motor 33, and a rotation detecting unit 34. The rotation holder 31 is inserted from both sides of a hollow RP1 provided in the roll body RP, and a pair of rotation holders 31 are provided to support the roll body RP from both sides.

The RR motor 33 applies driving power (rotation power) to a rotation holders 31*a* positioned on one side of the pair of rotation holders 31 through the gear 32. In the embodiment, a rotary encoder is used as the rotation detecting unit 34. For this reason, the rotation detecting unit 34 includes a disc-shaped scale 34*a* and a rotary sensor 34*b*. The disc-shaped scale 34*a* includes light transmitting portions allowing light to pass, and light blocking portions blocking the transmission of light at a regular interval along a circumferential direction thereof. The rotary sensor 34*b* includes a light emitting device (not shown), a light receiving device (not shown), and a signal processing circuit (not shown), as principal constituent elements.

Figure 4A:
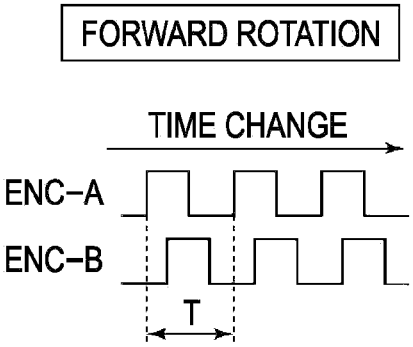
FIG. 4A and FIG. 4B are diagrams illustrating ENC signals.
Figure 4B:
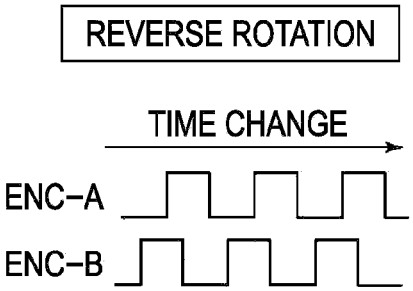

FIG. 4A and FIG. 4B are diagrams illustrating ENC signals. In the embodiment, pulse signals (A-phase ENC signal and B-phase ENC signal) with phases different by 90° from each other as shown in FIG. 4A and FIG. 4B are input to a control unit 100 by an output from the rotary sensor 34*b*. For this reason, it is possible to detect whether the RR motor 33 is in a forward rotation state or a reverse rotation state by proceeding and lagging of the phases. The main body portion 20 is provided with the carriage driving mechanism 40. The carriage driving mechanism 40 includes a carriage 41 and a carriage shaft 42 which are also a part of constituent elements of an ink supplying and ejecting mechanism, and further includes a carriage motor and a belt (not shown).

The carriage 41 includes an ink tank 43 for storing ink with colors (corresponding to fluid), and the ink is supplied from an ink cartridge (not shown) fixedly provided on the front side of the main body portion 20 to the ink tank 43 through a tube (not shown). As shown in FIG. 2, a printing head 44 that ejects ink droplets is provided under the carriage 41. The printing head 44 is provided with nozzle rows (not shown) corresponding to the ink, and piezoelectric devices (not shown) are provided for nozzles constituting the nozzle rows. The ink droplets are ejected from the nozzles at the ends of ink passages by operation of the piezoelectric devices.

The carriage 41, the ink tank 43, the tube (not shown), the ink cartridge, and the ink head 44 constitute the ink supplying and ejecting mechanism. The printing head 44 is not limited to the piezoelectric driving type using the piezoelectric devices. For example, a heater type of using power of bubbles generated by heating ink using a heater, a magnetostrictive type of using magnetostrictive devices, and a mist type of controlling mist in an electric field may be employed. Any kind of ink such as dye ink and pigment ink may be used as the ink filling up the ink cartridge and ink tank 43.

Figure 5:
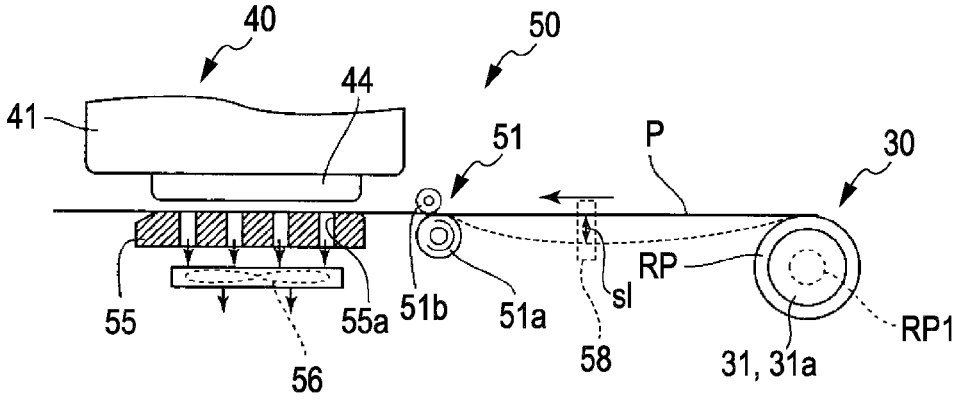
FIG. 5 is a diagram illustrating positional relation of a roll body, a pair of transport rollers, and a printing head.

FIG. 5 is a diagram illustrating a positional relation of the roll body RP, a pair of transport rollers 51, and the printing head 44. As shown in FIG. 2 and FIG. 5, the paper transport mechanism 50 includes the pair of transport rollers 51, a gear 52, a PF motor 53, and rotation detecting unit 54. The pair of transport rollers 51 includes a transport driving roller 51*a* and a transport driven roller 51*b*, and the paper P coming from the roll body RP is pinched therebetween. The PF motor 53 applies a driving power (rotation power) to the transport driving roller 51*a* through the gear 52. A rotary encoder is used as the rotation detecting unit 54 of the embodiment, includes a disc-shaped scale 54*a* and a rotary sensor 54*b* similarly to the rotation detecting unit 34 described above, and output the pulse signals shown in FIG. 4A and FIG. 4B.

A platen 55 is provided on the downstream side (paper discharge side) of the pair of transport rollers 51, and the paper P is guided on the platen 55. The printing head 44 is provided to be opposed to the platen 55. The platen 55 is provided with suction holes 55*a*. The suction holes 55*a* are formed to communicate with a suction fan 56, and the air is sucked from the printing head 44 through the suction holes 55*a* by operating the suction fan 56. Accordingly, when the paper P is placed on the platen 55, it is possible to suck and hold the paper P. In addition, the printer 10 is provided with various sensors.

Figure 6:
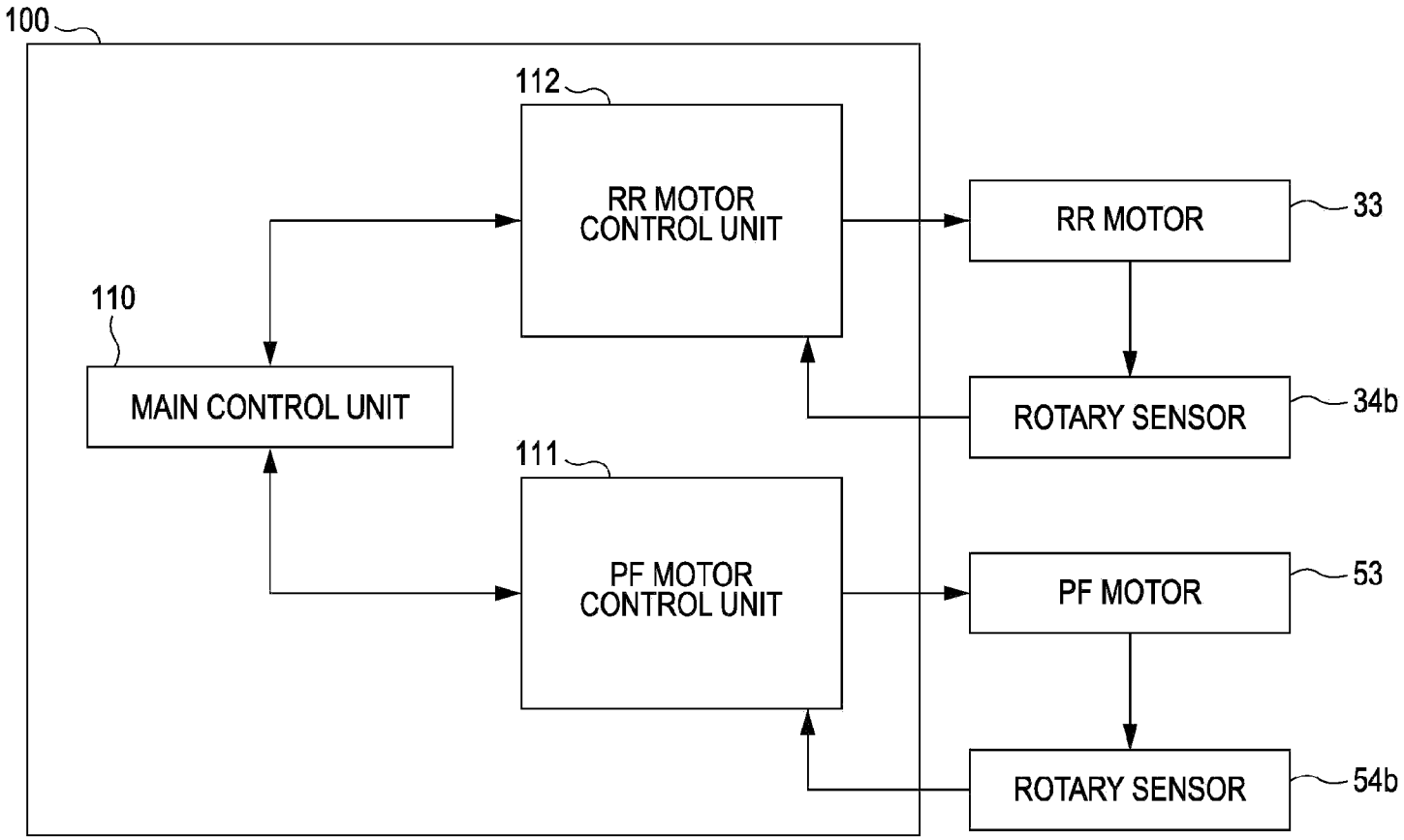
FIG. 6 is a block diagram illustrating an example of a functional configuration of a control unit.

FIG. 6 is a block diagram illustrating an example of a functional configuration of the control unit 100. Various output signals of the rotary sensors 34*b* and 54*b*, a linear sensor (not shown), a paper width detecting sensor 57, a gap detecting sensor (not shown), an operation panel of the printer 10, and the like are input to the control unit 100. As shown in FIG. 2, the control unit 100 includes a CPU 101, a ROM 102, a RAM 103, an NVRAM 104, an ASIC 105, and a motor driver 106, and they are connected to each other through a transport path 107 such as a bus. The control unit 100 is connected to a computer COM. A main control unit 110, a PF motor control unit 111, and an RR motor control unit 112 shown in FIG. 6 are realized by association of such hardware, the ROM 102, and stored software and/or data, or addition of a circuit or a constituent element performing a specific process.

The PF motor control unit 111 of the control unit 100 controls driving of the PF motor 53 to rotate the transport driving roller 51*a* to transport the paper P in the transport direction. Hereinafter, the direction of the rotation of the PF motor 53 when the paper P is transported in the transport direction is referred to as a forward rotation direction. The RR motor control unit 112 controls driving of the RR motor 33 to supply the paper P. The direction of the rotation of starting rolling the paper P from the roll body RP is the forward rotation direction of the RR motor 33, and the direction of the rotation reversely rolled is the reverse rotation direction. The main control unit 110 controls operations of the PF motor control unit 111 and the PR motor control unit 112. The control unit 100 performs processes in association with the main control unit 110, the PF motor control unit 111, and the RR motor control unit 112.

Control of RR Motor 33

According to the size of the roll body RP, there is a case where it is difficult to appropriately supply the paper P from the roll body RP due to the inertia moment generated from the weight thereof. Specifically, it is difficult to appropriately stop the roll body RP and more of the paper P is supplied than necessary, according to the magnitude of the inertia moment. In the embodiment, the following control is performed considering a risk when guiding the paper P too much as described above.

Figure 7:
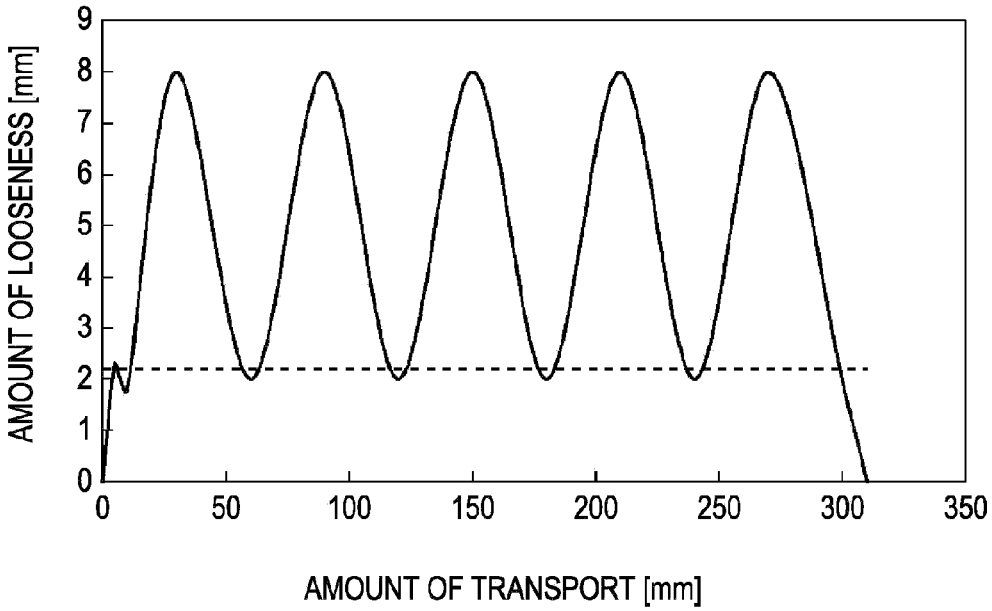
FIG. 7 is a graph illustrating management of looseness and management of tension.

FIG. 7 is a graph illustrating management of looseness and management of tension. The amount of looseness in the embodiment is an amount of looseness generated between the pair of transport rollers 51 and the roll body RP (hereinafter, merely referred to as "amount of looseness"), and is a distance from a position where the paper P is tight to the most recessed part of the loosened paper P. Specifically, sl shown in FIG. 5 is the amount of looseness.

The horizontal axis of the graph of FIG. 7 is the amount of transport of the paper P, and the vertical axis is the amount of looseness of the paper P generated between the pair of transport rollers 51 and the roll body RP. Every unit is a "mm (millimeter)". In the graph, a line representing a threshold value at a position where the amount of looseness is about 2.2 mm is shown. The threshold value of 2.2 mm is an example, and the other value may be used according to conditions.

In the embodiment, when the amount of looseness is larger than the threshold value, the rotation of the RR motor 33 is controlled on the basis of the acquired amount of looseness. Meanwhile, when the amount of looseness is equal to or less than the threshold value, the rotation of the RR motor 33 is controlled on the basis of the tension between the pair of transport rollers 51 and the roll body RP. The method of controlling the amount of looseness on the basis of the acquired amount of looseness (hereinafter, referred to as "management of looseness", and the method of controlling the amount of looseness on the basis of the tension (hereinafter, referred to as "management of tension") will be described later.

Management of Looseness

As an aspect of acquiring the amount of looseness, there is a method of using a looseness sensor 58. For example, the looseness sensor 58 is a sensor capable of detecting a position of the paper in the up and down direction. By employing such a sensor, it is possible to acquire the amount of looseness representing how much the paper P is loosened in comparison with the case where the paper P is tight.

In the management of looseness, the RR motor 33 is controlled such that the amount of looseness of the paper P is a predetermined target amount of looseness. In the embodiment, the target amount of looseness is set to 5 mm. The RR motor 33 may be controlled such that a difference obtained by reducing the acquired amount of looseness from the target amount of looseness is zero. For example, the RR motor 33 may be rotated by a duty control of performing a PID control such that the difference is zero. In such a manner, when the amount of looseness is larger than the predetermined threshold value, it may be a proper amount of looseness.

In the description, the amount of looseness of the paper P is acquired using the looseness sensor 58, but the amount of looseness of the paper P may be calculated on the basis of information obtained from the rotation detecting unit 34 of the RR motor 33 and the rotation detecting unit 54 of the PF motor 53. It is possible to obtain an amount of transport Feed_roll of the paper P from the amount of rotation of the RR motor 33 obtained from the rotation detecting unit 34 and the diameters of the gear 32 and the roll body RP. The diameter of the roll body RP may be estimated on the basis of the amount of already transported paper P. In addition, it is possible to obtain an amount of transport Feed_pf of the paper P from the amount of rotation of the PF motor 53 obtained from the rotation detecting unit 54 and the diameters of the gear 52 and the rotation holder 31. Accordingly, it is possible to estimate an amount of looseness occurring at the present time, by subtracting the amount of transport Feed_pf from the amount of transport Feed_roll.

The target amount of looseness may be varied according to the thickness of the paper. For example, in a case of thin paper, there is an advantage that the paper does not crinkle when the tension is relatively strong. In such a case, the target amount of looseness may be set to 0 mm.

Management of Tension

Figure 8:
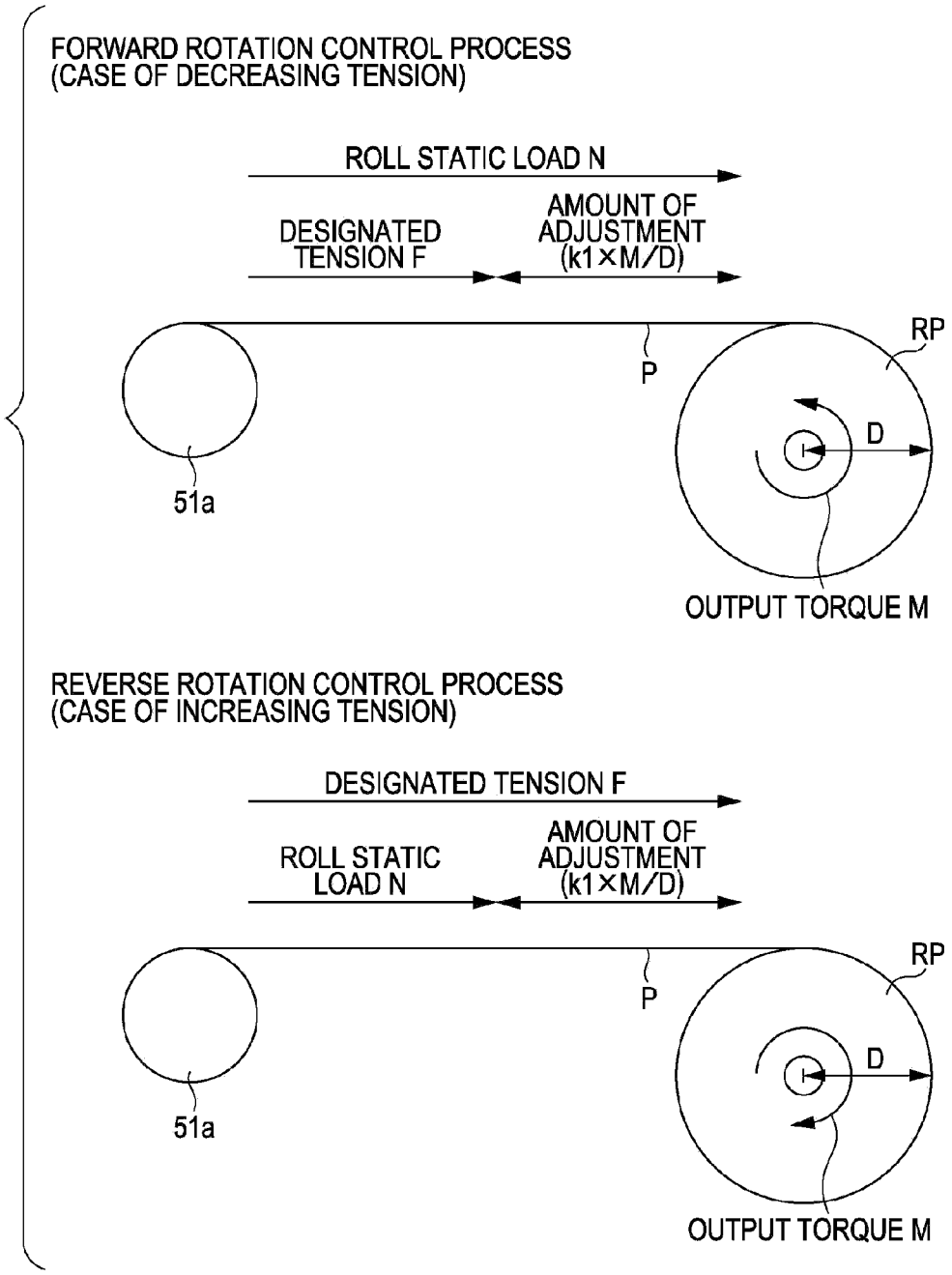
FIG. 8 is a diagram schematically illustrating a concept of designated tension.

FIG. 8 is a diagram schematically illustrating the concept of the designated tension F. FIG. 8 shows relation of the roll body RP, the pair of transport rollers 51, and the paper P. In the paper transport process, the PF motor control unit 111 drives the transport driving roller 51*a* (does not drive the RR motor 33) to transport the paper P in a predetermined transport velocity V. Then, the roll body RP is driven to forwardly rotate to be pulled into the paper P, but a torque of a roll static load N for rotating the roll body RP is generated around the driving shaft (the rotation shaft of the roll body RP) of the RR motor 33. To transport the paper P against the roll static load N acting on the rotation shaft of the roll body RP, a tension T satisfying the condition of at least the following formula (1) is generated from the balance of the moment around the rotation shaft of the roll body RP, where tension T is the tension acting on the paper P positioned on the surface of the roll body RP.

$$T \times D = k1 \times N$$

$$T = k1 \times N/D \quad (1)$$

In the state where the paper P is transported at the predetermined transport velocity V without driving the RR motor 33, the tension T satisfying at least the formula (1) acts. In the formula, k1 is a proportional integer, and may be specified on the basis of the diameter of the rotation shaft of the roll body RP. The relation between the transport velocity V and the roll static load N necessary to rotate the roll body RP may be obtained by advance estimation. Accordingly, it is possible to specify the tension T generated when transporting the paper P at an arbitrary transport velocity V without driving the RR motor 33.

Next, it is assumed that the RR motor 33 is driven. When the PF motor control unit 111 performs the PWM output on the RR motor 33 and the RR motor 33 generates an output torque M in the forward rotation direction, a torque obtained by subtracting the output torque M from the roll static load N acts around the rotation shaft of the roll body RP. In this case, the following formula (2) is obtained on the basis of the formula (1).

$$T \times D = k1 \times (N - M)$$

$$T = k1 \times (N - M)/D \quad (2)$$

As shown in the formula (2), it is possible to reduce the tension T acting on the paper P by forwardly rotating (M>0) the RR motor 33 while transporting the paper P. In addition, the magnitude of the tension T (amount of adjustment) reduced by the output torque M is k1×M/D. On the other hand, when the negative output torque M (reverse rotation direction) is applied to the RR motor 33, it is possible to increase the tension T. When the tension T is too large, the amount of slip between the transport driving roller 51*a* and the paper P is increased, and thus it is difficult to realize the intended amount of transport. The amount of slip is proportional to the tension T. When the tension T is too small, the roll body RP is spontaneously positively rotated to cause the looseness of the paper P.

In the embodiment, the target value of the tension T is set to the designated tension F. By substituting the designated tension F in the formula (2), it is possible to calculate the output torque M of the RR motor 33 necessary to realize the designated tension F. Appropriately estimated values may be used as the diameter D of the roll body RP and the roll static load used in the above (5), by a new update after each printing process. In such a manner, it is possible to accurately calculate the output torque M.

$$\text{Duty} = k2 \times M \quad (3)$$

As shown in the formula (3), since the duty value of the PWM signal for generating the output torque M is proportional to the output torque M, the RR motor control unit 112 can perform the control for realizing the designated tension F. In addition, k2 corresponds to the proportional constant for regulating the duty. Since the mechanical characteristics of the paper P are different according to kinds of the paper P, the designated tension F is prepared for each kind of the paper P and stored in advance in the ROM 102. In a case of thick paper P, great power is necessary for deformation for starting rolling from the rolled state on the plane, and thus it is preferable to set the designated tension F larger than that of the thin paper P.

In such a manner, it is possible to feed the paper P considering the self-propellent risk of the roll body RP generated from the rotation moment by changing the control of looseness and the control of tension, according to the amount of looseness of the paper P. That is, it is possible to appropriately adjust the amount of looseness of the paper P between the roll body and the transport roller.

Other Embodiments

In the embodiment described above, the printer 10 has been described as the liquid ejecting device, but the invention is not limited thereto. A liquid ejecting device which ejects or sends out another fluid (liquid, liquid-form material in which particles of functional materials are dispersed, and fluid such as gel) other than the ink may be embodied. For example, the same technique as described in the embodiment may be applied to various devices applying the ink jet technique, such as a color filter producing device, a dyeing device, a microprocessing device, a semiconductor producing device, a surface processing device, a 3-dimensional modeling device, a gas vaporizing device, an organic EL producing device (particularly, polymer EL producing device), a display producing device, a film forming device, and a DNA chip producing device. Such a method or a production method falls within the application scope.

A printing method of feeding the paper P in the method described above falls within the embodiment, and a program for realizing such a printing method falls within the embodiment.

The embodiments described above are to easily understand the invention, but are not to restrictively analyze the invention. The invention may be modified and improved without deviating from the concept thereof, and it is natural that the invention includes the equivalents thereof.

What is claimed is:

1. A printing device comprising:

a driving motor that applies a driving power rotating a roll body in which a medium is rolled;

a holder that holds the roll body and that transfers the driving power of the driving motor to the roll body;

a transport motor that applies a driving power transporting the medium rolled out from the roll body;

a transport roller that is provided further to the downstream side than the roll body in a transport direction of the medium and transfers the driving power of the transport motor to the medium;

a looseness amount acquiring unit that acquires an amount of looseness between the holder and the transport roller; and a controller that controls the driving motor when the amount of looseness is equal to or more than a predetermined amount of looseness, the controller controlling the driving motor on the basis of the amount of looseness acquired by the looseness amount acquiring unit, and when the amount of looseness is less than the predetermined amount of looseness, the controller controlling the driving motor on the basis of tension between the holder and the transport roller, wherein the looseness amount acquiring unit includes a sensor which detects a position of the medium in a vertical direction, and wherein the sensor is arranged extending from above the medium to below the medium when the medium is tight.

2. The printing device according to claim 1, wherein the looseness amount acquiring unit acquires the amount of looseness by measuring an amount of looseness of the medium.

3. The printing device according to claim 1, wherein the looseness amount acquiring unit acquires the amount of looseness on the basis of an amount of transport of the medium transported by the holder and an amount of transport of the medium transported by the transport roller.

4. The printing device according to claim 1, wherein the amount of looseness is a position of the medium in the vertical direction, which is perpendicular to the transport direction of the medium, and the tension is a tension acting on the medium positioned on a surface of the roll body.

5. The printing device according to claim 4, wherein the driving motor being controlled on the basis of the tension comprises adjusting an output torque of the driving motor based at least on a diameter of the roll body and on a roll static load necessary to rotate the roll body.

6. The printing device according to claim 5, wherein the diameter of the roll body is based at least on an amount of the medium already transported.

7. The printing device according to claim 4, wherein the driving motor being controlled on the basis of the amount of looseness comprises adjusting an output torque of the driving motor until the amount of looseness achieves a predetermined target amount of looseness, and the driving motor being controlled on the basis of the tension comprises adjusting an output torque of the driving motor until the tension achieves a predetermined target tension.

8. The printing device according to claim 7, wherein the predetermined target tension is based at least on a diameter of the roll body and on a roll static load necessary to rotate the roll body.

9. The printing device according to claim 1, wherein the tension is a tension acting on the medium positioned on a surface of the roll body.

10. The printing device according to claim 1, wherein the tension is based at least on a diameter of the roll body and on a roll static load necessary to rotate the roll body.

11. The printing device according to claim 10, wherein the diameter of the roll body is based on an amount of the medium already transported.

12. The printing device according to claim 1, further comprising a head that ejects ink onto the medium, wherein the transport roller comprises a pair of transport rollers, the pair of transport rollers being the only rollers positioned between the holder and the head.

13. The printing device according to claim 1, wherein the sensor is arranged outside of a transport path in which the medium is transported.

14. A printing method of a printing device including a driving motor that applies a driving power rotating a roll body in which a medium is rolled, a holder that holds the roll body and that transfers the driving power of the driving motor to the roll body, a transport motor that applies a driving power transporting the medium, a transport roller that is provided further to the downstream side than the roll body in a transport direction of the medium and transfers the driving power of the transport motor to the medium, and a looseness amount acquiring unit that acquires an amount of looseness between the holder and the transport roller, the method comprising:

acquiring the amount of looseness between the holder and the transport roller using a sensor which detects a position of the medium in a vertical direction, the sensor being arranged extending from above the medium to below the medium when the medium is tight;

controlling the driving motor on the basis of the amount of looseness acquired by the looseness amount acquiring unit when the amount of looseness is equal to or more than a predetermined amount of looseness; and controlling the driving motor on the basis of tension between the holder and the transport roller when the amount of looseness is less than the predetermined amount of looseness.

15. A program executed on a printing device including a driving motor that applies a driving power rotating a roll body in which a medium is rolled, a holder that holds the roll body and that transfers the driving power of the driving motor to the roll body, a transport motor that applies a driving power transporting the medium rolled out from the roll body, a transport roller that is provided further to the downstream side than the roll body in a transport direction of the medium and transfers the driving power of the transport motor to the medium, and a looseness amount acquiring unit that acquires an amount of looseness between the holder and the transport roller, the program causing the printing device to execute:

acquiring the amount of looseness between the holder and the transport roller using a sensor which detects a position of the medium in a vertical direction, the sensor being arranged extending from above the medium to below the medium when the medium is tight;

controlling the driving motor on the basis of the amount of looseness acquired by the looseness amount acquiring unit when the amount of looseness is equal to or more than a predetermined amount of looseness; and controlling the driving motor on the basis of tension between the holder and the transport roller when the amount of looseness is less than the predetermined amount of looseness.

* * * * *